United States Patent [19]

Tate, Jr.

[11] 3,974,829

[45] Aug. 17, 1976

[54] MEANS FOR PREVENTING FOGGING OF OPTICAL AIDS USED BY THE WEARER OF A SURGICAL MASK

[75] Inventor: George W. Tate, Jr., Dallas, Tex.

[73] Assignees: Giles C. Clegg, Jr.; John R. Lynn, both of Dallas, Tex. ; part interest to each

[22] Filed: July 8, 1974

[21] Appl. No.: 486,594

[52] U.S. Cl. ..... 128/146.2; 128/139

[51] Int. Cl.[2] ..... A61M 16/00

[58] Field of Search..... 128/146.2, 146.3, 146.6, 128/146.7, 146, 139, 141 R, 145.5, 145.6, 145.7, 132 R; 2/14 K

[56] References Cited

UNITED STATES PATENTS

| | | | |
|---|---|---|---|
| 3,316,903 | 5/1967 | Richards | 128/145.7 |
| 3,664,335 | 5/1972 | Boucher | 128/146.6 |
| 3,721,238 | 3/1973 | Wise et al. | 128/188 |
| 3,782,377 | 1/1974 | Rychlik | 128/132 R |
| 3,834,384 | 9/1974 | Raines | 128/146.2 |
| 3,888,246 | 6/1975 | Lauer | 128/146.2 |

FOREIGN PATENTS OR APPLICATIONS

| | | | |
|---|---|---|---|
| 1,806,129 | 2/1968 | Germany | 128/146.2 |
| 893,614 | 4/1962 | United Kingdom | 128/146.2 |

*Primary Examiner*—Robert W. Michell
*Assistant Examiner*—Henry J. Recla
*Attorney, Agent, or Firm*—Giles C. Clegg, Jr.

[57] ABSTRACT

A surgical mask is provided with means for preventing fogging of optical aids used by the wearer. The means comprises a strip of pliable material bonded to a layer of soft foam interposed between the upper edge of the mask and the wearer's face. An air impervious film sheathes the layer of foam and extends laterally therefrom a sufficient distance to cover an upper portion of the mask in the area below the wearer's eyes. The interposed material shapes itself and sufficiently extends over the wearer's face to form a seal and a moisture barrier preventing fluid vapor in the wearer's breath from contacting eye glasses or other optical instruments worn by the wearer and susceptible to fogging.

11 Claims, 5 Drawing Figures

MEANS FOR PREVENTING FOGGING OF OPTICAL AIDS USED BY THE WEARER OF A SURGICAL MASK

BACKGROUND OF THE INVENTION

1. Field of Invention

The present invention relates to face masks and more particularly to means for preventing fogging of optical aids used by a wearer of a surgical face mask.

2. Technical Considerations

Face masks are generally worn to reduce the amount of contamination either exhausted from or inhaled by the wearer. Among these are masks of the sterile, surgical variety, necessities for hospital operating rooms. Surgical face masks are worn by surgeons and others around an operation to substantially prevent the contamination and infection of the patient from the wearers during operations. Effective and comfortable masks are available which are both disposable and nondisposable. The advantage of disposability is the elimination of the expensive sterilizing procedure and inherent danger of cross-contamination.

Surgical masks are generally lightweight in construction and contain several features designed for adaptation to an individual wearer's features. There is often incorporated within the mask, along the upper edge, an elongated, deformable metal strip having sufficient stiffness to retain any shape given it. In this way, the upper portion of the mask may be contoured to the wearer's face to improve the upper edge fit. A relatively thin strip of soft foam material is sometimes found along this upper edge to increase the comfort of the wearer.

Although the upper edge may be contoured in a variety of facial shapes to most closely approximate the wearer's features, it is inadequate to prevent the wearer's breath from rising between his or her face and the mask. Since these masks are not designed to obstruct breathing, but rather to provide a breath filter, some breath exhausts through the upper portion of the mask into the vicinity of the wearer's eyes. The breath being warm and moist, holds fluid vapor which readily condenses on cooler objects. Such cooler objects may be present in the air-conditioned operating rooms in the form of glass lenses of optical aids used by the surgeons and assistants. Such optical aids include spectacles, surgical loupes and surgical microscopes.

The exhaust of exhaled breath is resisted to some degree by the mask itself, prompting some breath to flow under the mask edges. Because warm air rises, the wearer's breath also has a natural tendency to rise under the upper mask edge and through the upper mask surface area producing fogging of the optical aids positioned in the vicinity of the wearer's eyes. This obscuration of the wearer's vision is a nuisance at best and a hazard at worst. This shortcoming of the prior art mask often requires the surgeon to pause to clear the lenses of condensation interfering with his or her vision. The necessity for clear vision during surgical procedures as well as the time expediency element has fostered a need for preventing such fogging.

One attempt to eliminate fogging has been the chemical treatment of optical lenses to reduce condensation to vapor thereon. Such attempts deal with the problem rather than eliminating it. The most economical and straightforward approach would be to prevent the moist air from the breath of the wearer of the optical aids from contacting them. Thus, some surgeons have resorted to the expediency of using strips of adhesive tape to seal the upper edge of the mask against their face. The tape by necessity adheres to the tender skin beneath the eyes. Since a surgeon may operate several times in one day, the tape may be removed numerous times causing severe chafing and irritation in this area. Aside from the chafing and inconvenience to the surgeon, this means poses possible problems with allergy to the tape in some persons, and even so-called "hypoallergenic" tapes can cause skin irritations. The serious import of the fogging effect for both the wearer and the patient has thus necessitated an effective method of and means for eliminating this problem.

SUMMARY OF THE INVENTION

One object of the present invention is to provide a new and improved means for preventing the fogging of optical aids used by a wearer of a face mask.

Another object of the present invention is to provide a new and improved means for substantially reducing the amount of a wearer's breath which rises through a surgical face mask in the vicinity of the wearer's eyes.

It is a further object of the present invention to provide a new and improved means for sealing a surgical face mask against the wearer's face to prevent the rise of the wearer's breath in the vicinity of the wearer's eyes.

It is a further object of the present invention to provide a surgical face mask with a contouring seal along the upper edge thereof which substantially prevents the rising of the wearer's breath from beneath the face mask around the vicinity of the wearer's eyes.

A still further object of the present invention is to provide a simple, inexpensive device which may be incorporated in or attached to a surgical face mask to substantially eliminate the fogging of optical instruments or aids used by the wearer of the mask.

A new and improved means for preventing fogging of optical aids and instruments used by a person wearing a surgical mask, in accordance with the principles of the present invention, includes an elongated cushioning element for interpositioning between the upper mask edge and the wearer's face, a strip of pliable material secured along the upper edge of the mask of sufficient retentivity to retain its shape upon deformation and compress the cushioning element to form a seal, and a sheet of air impervious film covering a sufficient portion of the upper part of the mask to prevent fluid vapor in the wearer's breath from reaching the vicinity of the wearer'eyes.

The pliable strip may be similar to the kind utilized in the prior art which can be contoured to the wearer's face but having sufficient retentivity to retain that shape and hold the elongated cushioning element against the wearer's face with sufficient pressure to form an upper edge seal between the mask and the wearer's skin. The cushioning element may be contoured to provide better sealing characteristics and facilitate down-vision. The air impervious film covers a sufficient portion of the upper area of the mask to block the rise of the exhausted breath deflecting it away from the vicinity of the wearer's eyes. The film may be as wide as the length of the wearer's nose to provide an effective moisture barrier in the vicinity of the wearer's eyes.

The device may be incorporated as a part of the mask itself or an attachment thereto. By providing an adhesive backing on one side of the film, the device can be secured along the upper edge of most types of existing surgical masks. The invention thereby provides the advantages described herein for surgical face masks of both the disposable and nondisposable types. When used with those masks already embodying a pliable strip of sufficient retentivity along the upper edge, a device need comprise only the contoured foam layer and the air impervious sheet. Thus, only wearers needing optical aids such as glasses or surgical loupes need take advantage of the attachment or the modified face mask. The moisture barring and sealing characteristics are thus provided in a manner which facilitates maximum utilization of any desired mask and meets the needs of individual wearers.

DESCRIPTION OF THE DRAWINGS

The objects and various features of the present invention will be understood from the following detailed description thereof when read in conjunction with the accompanying drawings, wherein.

DESCRIPTION OF THE PREFERRED EMBODIMENT

Figure 1:
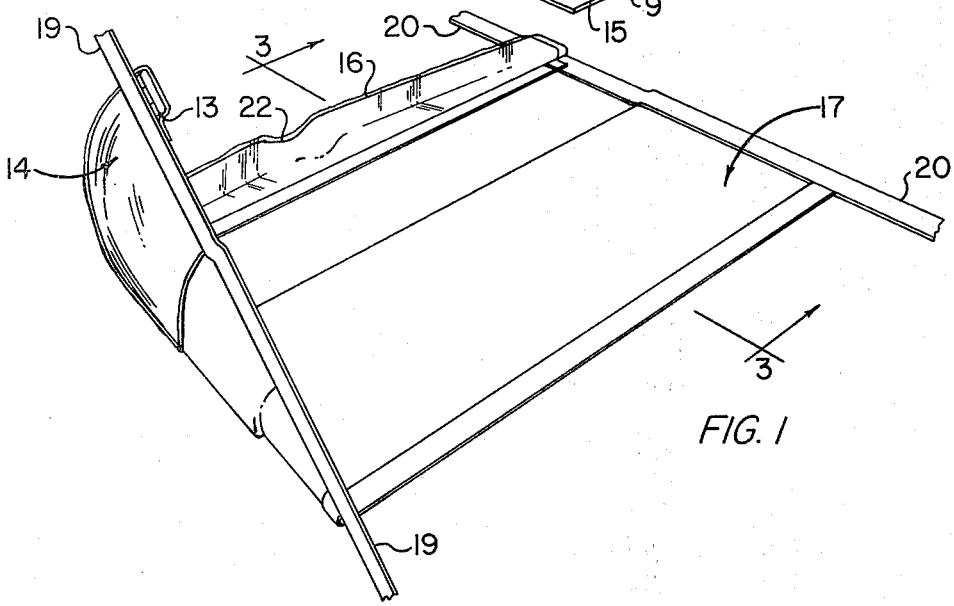
FIG. 1 is a perspective view of a surgical face mask with a device for eliminating the fogging of optical aids operably affixed thereto.

Attention is first directed to FIG. 1 wherein a surgical face mask 17 is shown having a rectangular shape and formed of high efficiency filter material of the disposable variety. The filter construction allows the inhalation and exhaustion of air therethrough while preventing the passage of airborne bacteria. The mask 17 may be of the laminated type including a soft inner liner of filter material and a durable, thin outer cover. It may be pleated or folded in the center to provide sufficient room for expanding around the wearer's nose and chin and to provide a sufficient surface area for substantially filtering all of the wearer'breath therethrough.

Figure 2:
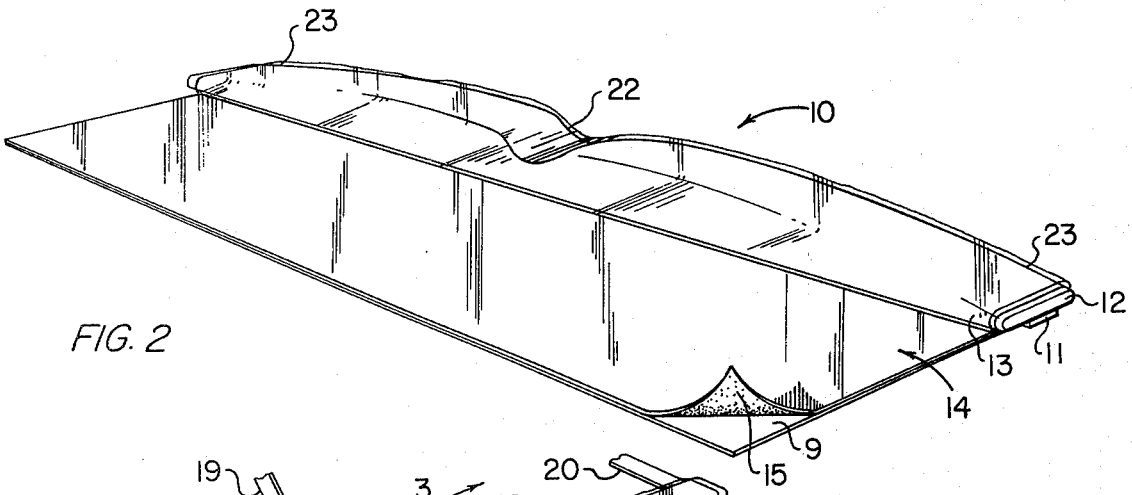
FIG. 2 is a perspective view of the device embodying the principles of the present invention as shown affixed to a surgical mask in FIG. 1.

Attention is next directed to the upper portion of the mask 17 wherein a fog eliminating device 10 as most clearly shown in FIG. 2 is affixed and includes a pliable strip of material 11 bonded to an elongated cushioning strip 12, both sheathed by a sleeve 13 formed by and along an edge of a sheet of impervious film 14. A coating of adhesive material 15 is provided on the bottom surface of the film 14. A suitable, removable backing 9 is provided to protect the adhesive 15 prior to attachment to a mask 17.

Figure 4:
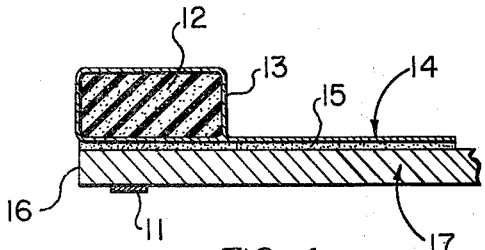
FIG. 4 is the same view as FIG. 3 illustrating a different embodiment of the invention and of the mask.
Figure 3:
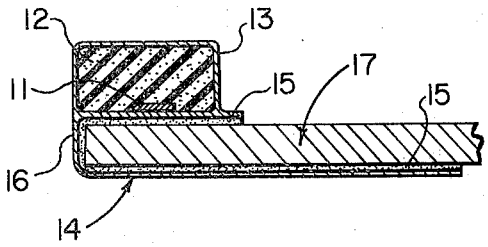
FIG. 3 is an enlarged, side elevational, cross-sectional view of the mask and the device attached thereto as shown in FIG. 1 and taken along the line 3—3 thereof.

As shown most clearly in FIGS. 2, 3, and 4, the device 10 is affixed by the adhesive 15 to an upper edge 16 of the mask 17. The sheet 14 may be positioned across the outside (FIG. 3) or inside (FIG. 4) upper surface of the mask 17. The sheet 14 is preferably folded along the edge 16 with the sheet 14 across the outside of the mask 17 as shown in FIG. 3. In this manner the sheathed strip 11 and cushion 12 extend along the inside top portion of the mask 17.

Figure 5:
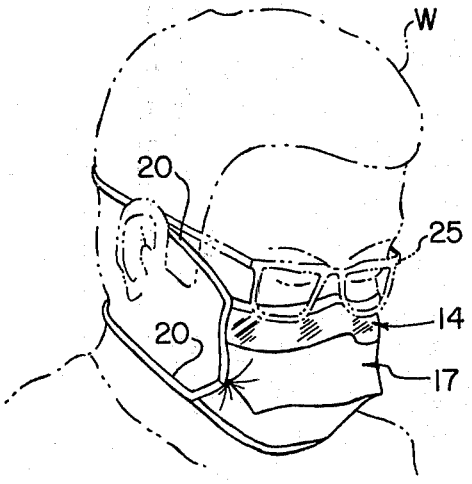
FIG. 5 is a perspective view of the mask and the device attached thereto, as shown in FIG. 1, positioned on a wearer's face outlined in phantom.

As shown in FIG. 5, the mask 17 is secured to wearer W in the usual fashion. Elongated ribbons or ties 19 and 20, form the side edges of the mask 17 (FIG. 1) and hold the mask 17 against the face of the wearer W. The upper edge ties 19 and 20 are fastened sufficiently tight to pull the pliable strip of material 11 in a select, contoured shape toward the wearer's face. The strip 11 in this contoured shape compresses the cushion 12 along its length and produces a seal between the upper edge 16 and the wearer's face.

As appears most clearly in FIG.'S 2 and 3, the pliable strip 11 and the cushion 12 are enclosed by the sleeve 13 of the impervious sheet 14. This preferred design allows the use of a porous, open celled foam material for the cushion 12. The sleeve 13 is not necessary if material for the cushion 12 is nonporous, such as closed cell foam, and can serve as a seal without the covering of the sheet 14. In either design, the sheet 14 extends substantially along the full length of the upper edge 16 of the mask 17 at a width of generally up to 1.5 inches, which is sufficient to form an effective moisture barrier by extending over the length of the wearer's nose (FIG. 5). Sheet 14 is thin, lightweight in construction and fabricated from inexpensive air impervious material, having a precoated adhesive backing. The essential characteristic of the sheet 14 is that it be an effective barrier to the transfer of moisture therethrough, and air impervious materials are the most effective in this application.

The cushion 12 has a generally rectangular cross-sectional shape and may be formed from a soft resilient foam of either an open or closed celled variety. Polyurethane foam is a suitable material having high compressibility to conform to the contours of the wearer's face. As shown in FIG. 2, the central portion of the cushion 12 has a curve or notch 22 formed therein and is thickest at the portions on the opposite sides of the curved portion 22 tapering down to thinner portions at the opposite edges 23—23. The amount of curvature is dependent upon the compressibility characteristic of the foam. The more compressible the foam the less preformed contour is required for conforming to the wearer's face and providing the necessary seal. The curve 22 of the cushion 12 accommodates the wearer's nose. The end portions 23—23 of the cushion 12 are of reduced thickness to increase the applied compressive force in the center of the mask 17 and facilitate the down-vision of the wearer in this area. The forces holding the mask 17 to the wearer's face are thus more uniformly distributed across the upper edge 16 of the mask 17 by providing this contour.

An effective contour is defined by relating cushion 12 thickness to its maximum thickness. In accordance with one specific example of the invention, a thickness variation of one-half maximum thickness near the curve 22 has proven to be suitable to accommodate the wearer's nose. A thickness variation of one-third maximum thickness at the ends 23—23 has proven to be effective to eliminate interference with the wearer's down-vision in this area. These variations relate to a maximum thickness of 0.375 inches in a cushion 12 formed of an open celled polyurethane foam. The contoured shape of cushion 12 thus accommodates the basic facial structure of the average wearer to enhance the individually conforming and sealing qualtities of the device 10.

The pliable strip 11 is affixed to the cushion 12 by any suitable means such as bonding thereto by a suitable adhesive. The pliable strip 11 comprises a malleable material such as aluminum. Such a soft metal is readily deformable and yet of sufficient retentivity to maintain the shape given it for the necessary compression of the cushion 12. Slight pressure applied by the wearer's fingers deforms strip 11 about the nose of the wearer conforming the device 10 to the wearer's individual cheek and nose bone contours. By securely fastening the mask 17 to the wearer's face by the ties 19 and 20, the contoured strip 11 then provides the necessary compressive force to cushion 12 forming the desired seal.

As appears most clearly in FIG. 4, device 10 may be adapted for attachment to surgical masks 17 already having a pliable strip fabricated therein. The pliable strip is usually located on the outside surface of such a mask as shown. A variety of such masks 17 are available but the pliable strip is often not of sufficient length or retentivity to provide a suitable contour for use in place of strip 11. A suitable pliable strip is one which retains the contoured shape given it while being tightly pulled against the face of the wearer. The strip 11 will preferably extend substantially the length of the edge 16. For a mask 17 already formed with a suitable pliable strip, device 10 is formed without the strip 11 and is otherwise the same in construction and application. As stated above, the position of the sheet 14 in FIG. 4, across the inside of the mask 17 is an illustration of an alternative method of attaching the device 10.

As shown in FIG. 5, the fogging of an optical aid 25 used by the wearer W of a surgical mask 17 may be prevented by the device 10 described above, which can most economically be utilized by integrating or incorporating it in the mask 17 itself. In this manner the elements of the device 10 can be formed between or upon the layers of the upper portion of the mask 17. For example, the strip 11 and the sheet 14 can be effectively positioned within the upper portion of mask 17. The cushion 12 could then be suitably affixed along the edge 16, contiguous to the strip 11, by any conventional means.

The method of preventing fogging of optical aids 25 used by the wearer W of a surgical mask 17 by the device 10 is shown in FIG. 5. The sheet 14 in conjunction with cushion 12 forms a sealed barrier to both the air and the moisture, which barrier extends downwardly on the face mask 17 sufficiently to shield the necessary vicinity of the wearer's eyes. Warm breath would otherwise pass through the porous upper portion of the mask 17 as well as around the edge 16 thereof into the vicinity of the optical aid 25.

Further facilitating the effectiveness of the barrier to moisture exhausted in the area of the optical aid 25, is the seal formed between the cushion 12 and the face of the wearer W. The sleeve 13 around the cushion 12 effectively blocks any air that could pass therethrough. This design also positions the air impervious material against the skin. Furthermore, the skin of the wearer beneath the cushion 12 may be induced to perspire forming a narrow layer of moisture between the sheet 14 and the wearer's skin. This, however, serves to increase the effectiveness of the barrier by providing an additional seal in the form of a moisture layer which can absorb or block the rise of moisture vapor from the wearer's breath.

The above-described device is both comfortable for the wearer W and effective in preventing the fogging of optical aids. The device 10 may be supplied with or without the surgical mask 17. It is sufficiently durable for prolonged use, yet can be economically disposed of after a single application.

The operation and construction of the above-described invention will be apparent from foregoing description. While the particular embodiment shown and described has been characterized as being preferred, it will be obvious that various changes and modifications may be made therein without departing from the spirit and scope of the invention as defined in the following claims.

What is claimed is:

1. An improved surgical face mask comprising:

a rectangular body which is relatively impervious to bacteria yet porous enough for facilitating exhausting of the wearer's breath and having an upper edge, an upper portion and a lower portion;

an elongated cushioning element attached to a surface of said body adjacent the upper edge of the mask;

a sheet of air impervious material covering substantially the entire upper portion of the mask and affixed thereto to prevent the wearer's breath exhausted through said body reaching the vicinity of the wearer's eyes are fogging optical aids used by the wearer; means for securing the mask over the mouth and nose of the wearer; and an elongated, malleable strip attached to and extending substantially across the upper portion adjacent the upper edge of the mask, said strip being of a material having sufficient retentivity to retain its shape upon deformation and compress said cushioning element against the nose and cheekbones of the wearer for providing a seal between the upper edge of the mask and the wearers face;

said elongated cushioning element extending substantially across the upper portion adjacent the upper edge of the mask and contoured and including a central portion of reduced thickness adapted to be positioned over the bridge of the nose when the mask is worn and which is bounded by a pair of portions of maximum thickness which taper in directions away from said central portion toward portions of reduced thickness at the opposite edges of said cushioning element, said portions of maximum thickness being sufficiently thick to provide a seal in the vicinity of the wearers nose when compressed by the malleable strip and sufficiently tapered for the remainder to be in sealing contact with the wearer's face but not to interfere with the downward vision of the wearer.

2. A surgical mask as defined in claim 1 wherein said elongated cushioning element is of closed cell foam.

3. A surgical mask as defined in claim 1 wherein said air impervious film is affixed to the outside surface of the mask and covers the upper part of the mask extending over the length of the wearer's nose.

4. A device for attachment to a surgical face mask comprising:

an elongated cushioning element having first and second opposing longitudinal sides for interpositioning between the face of a wearer and the upper edge of the mask;

a deformable strip mounted on said first longitudinal side of said cushioning element and extending substantially the length thereof and having sufficient retentivity to retain its shape upon deformation and compress said cushioning element against the nose and cheekbones of the wearer for providing a seal between the upper edge of the mask and the wearers face;

said elongated cushioning element being contoured on said second longitudinal side and including a central portion of reduced thickness adapted to be positioned over the bridge of the nose when the mask is worn and which is bounded by a pair of portions of maximum thickness which taper in directions away from said central portion toward portions of reduced thickness at the opposite edges of said cushioning element, said portions of maximum thickness being sufficiently thick to provide a seal in the vicinity of the wearer's nose when compressed by the malleable strip and sufficiently tapered for the remainder to be in sealing relationship with the wearers face but not to interfere with the downward vision of the wearer;

a sheet of air impervious film affixed to said first longitudinal side of said of said cushioning element and extending laterally therefrom a predetermined distance; and means for attaching the device to the upper portion of a surgical face mask.

5. A device as defined in claim 4 wherein said sheet includes an elongated sheath formed along one edge thereof, enclosing said strip and said cushion longitudinally therearound.

6. A device as defined in claim 4 wherein said cushioning element is of closed cell form.

7. The apparatus as defined in claim 4 wherein said means for attaching comprises an adhesive backing on said air impervious film.

8. A device for attachment to a surgical face mask of the type having a body which is relatively impervious to bacteria yet porous enough for facilitating exhaustion of a wearer's breath, said mask having means for holding an upper edge of the mask in a contoured shape against the face of a wearer by providing therein a malleable strip of material havng sufficient retentivity to retain its shape upon deformation comprising:

an elongated cushioning element having first and second opposing longitudinal sides for interpositioning between the face of the wearer and the upper edge of the mask;

said elongated cushioning element being contoured on said first longitudinal side and including a central portion of reduced thickness adapted to be positioned over the bridge of the nose when the mask is worn and which is bounded by a pair of portions of maximum thickness which taper in directions away from said central portion toward portions of reduced thickness at the opposite edges of said cushioning element, said portion of maximum thickness being sufficiently thick to provide a seal in the vicinity of the wearers nose when compressed by the malleable strip and sufficiently tapered for the remainder to be in sealing contact with the wearer's face but not to interfere with the downward vision of the wearer;

a sheet of air impervious film covering said cushioning element and extending laterally from said second longitudinal side of said cushioning element a predetermined distance to cover a sufficient part of the upper portion of the mask to block the rise of the wearer's breath; and means for attaching said device to said surgical face mask.

9. A device as defined in claim 8 wherein said cushioning element comprises an elongated strip of closed cell foam material.

10. A device as defined in claim 8 wherein said sheet includes an elongated sheath formed along one edge thereof, enclosing said cushioning element longitudinally therearound.

11. A device for attachment to a surgical face mask of the type having a body which is relatively impervious to bacteria yet porous enough for facilitating exhaustion of a wearer's breath, comprising:

an elongated cushioning element having a length substantially equivalent to the length of the mask adapted for positioning along the upper inside edge thereof between the face of the wearer and the mask, which cushioning element is foam material having a central portion of reduced thickness bounded by portions of maximum thickness which taper in directions away from said central portion toward portions of reduced thickness at the opposite edges of said cushioning element;

an elongated malleable strip of material affixed contiguous to said cushioning element and adapted to be deformed to the contour of the wearer's face and having sufficient retentivity to retain its shape upon deformation and compress said cushioning element for providing a seal; and a sheet of air impervious film having an adhesive backing for attachment to the mask, said sheet sheathing said cushioning element and malleable strip, and extending laterally therefrom a distance sufficient to extend over the mask portion generally covering the length of the wearer's nose;

said sheet being adapted to attach to the upper outside portion of the mask, and fold over the upper edge of the mask allowing said sheathed cushioning element and malleable strip to be affixed to the upper inside edge of the mask forming a barrier and upper edge seal preventing fluid vapor in the wearer's breath from exhausting through or under the upper portion of the mask into the vicinity of optical aids used by the wearer and susceptible to fogging.

* * * * *